US006894684B2

(12) United States Patent
Shin et al.

(10) Patent No.: US 6,894,684 B2
(45) Date of Patent: May 17, 2005

(54) COMPUTER SYSTEM AND IMAGE PROCESSING METHOD THEREFOR

(75) Inventors: Seung-Gi Shin, Suwon (KR); Hae-Jin Hwang, Suwon (KR)

(73) Assignee: SamSung Electronics Co., Ltd., Suwon-si (KR)

( * ) Notice: Subject to any disclaimer, the term of this patent is extended or adjusted under 35 U.S.C. 154(b) by 197 days.

(21) Appl. No.: 09/941,623

(22) Filed: Aug. 30, 2001

(65) Prior Publication Data

US 2002/0060672 A1 May 23, 2002

(30) Foreign Application Priority Data

Nov. 18, 2000 (KR) ..... 2000-68761

(51) Int. Cl.[7] ..... G09G 3/36

(52) U.S. Cl. ..... 345/204; 345/87; 345/3.2; 315/85; 348/819

(58) Field of Search ..... 345/87–104, 204, 345/3.1, 3.2, 213, 1.1, 1.2, 534, 558, 573; 315/85; 348/819; 713/500, 600

(56) References Cited

U.S. PATENT DOCUMENTS 5,157,308 A * 10/1992 Rindal ..... 315/85
5,408,500 A * 4/1995 Ginzburg et al. ..... 375/288
5,631,920 A 5/1997 Hardin ..... 375/200
5,659,339 A 8/1997 Rindal et al. ..... 345/212
5,757,338 A * 5/1998 Bassetti et al. ..... 345/3
5,943,382 A 8/1999 Li et al. ..... 375/376
5,986,641 A 11/1999 Shimamoto ..... 345/150
6,229,513 B1 * 5/2001 Nakano et al. ..... 345/99
6,429,838 B1 * 8/2002 Go ..... 345/87
6,433,766 B1 * 8/2002 Chen ..... 345/87
6,580,432 B1 * 6/2003 Leung et al. ..... 345/558
6,720,943 B1 * 4/2004 Lee et al. ..... 345/87

FOREIGN PATENT DOCUMENTS

| | | |
|---|---|---|
| JP | 11-24035 | 1/1999 |
| JP | 11-313114 | 11/1999 |
| KR | 1998-076463 | 11/1998 |

* cited by examiner

*Primary Examiner*—Lun-yi Lao
(74) *Attorney, Agent, or Firm*—Robert E. Bushnell, Esq.

(57) ABSTRACT

Disclosed are a computer system and an image processing method, that can easily reduce the EMI (electromagnetic interference), introduced into a liquid crystal display using the spread spectrum. The computer system includes a graphic processing unit for converting the image signal provided from at least either of a central processing unit and a memory into a signal that can be displayed on a screen, and a spread spectrum unit, provided between the graphic processing unit and the liquid crystal display, for modulating a frequency of a clock signal from a clock generator within a predetermined frequency range.

16 Claims, 7 Drawing Sheets

COMPUTER SYSTEM AND IMAGE PROCESSING METHOD THEREFOR

CLAIM OF PRIORITY

This application makes reference to, incorporates the same herein, and claims all benefits accruing under 35 U.S.C. §119 from an application for COMPUTER AND IMAGE PROCESSING METHOD THEREOF earlier filed in the Korean Industrial Property Office on 18 Nov. 2000 and there duly assigned Serial No. 2000-68761.

BACKGROUND OF THE INVENTION

1. Field of the Invention

The present invention relates to a computer system and an image processing method therefor, and more particularly to a computer system and an image processing method that can reduce electromagnetic interference (EMI) introduced into a liquid crystal display (LCD) using a spread spectrum.

2. Description of the Background Art

In a computer system, a cathode-ray tube (CRT) monitor or an LCD monitor is used. The CRT monitor is usually used in a desktop computer, and the LCD monitor is usually used in a notebook computer.

Generally, in order to display an image signal using the CRT monitor, a graphic chipset is used. The graphic chipset transmits the signal to the CRT monitor using an RGB (red, green, and blue) interface, and for this, it converts a digital signal from a CPU (central processing unit) and memory into an analog signal that can be outputted to the monitor.

The LCD monitor receives converted data and clock signal using a graphic chipset and an LCD transmitter. The LCD and the LCD transmitter are connected together through a connector and a cable harness. Here, the LCD transmitter converts a data bus having RGB components into a low voltage differential signaling (LVDS) interface so that the image signal from the graphic chipset is transmitted to the LCD through copper lines at a high speed. The LCD transmitter and the graphic chipset are connected through about forty lines including thirty-six data lines and four clock signal lines to transmit the data and clock signal. Here, only one line between the two pairs of clock signal lines is for transmitting the clock signal, and the three remaining clock signal lines relate to the transmission of the clock signal.

Meanwhile, since the LCD transmitter and the LCD transfer the data using the LVDS interface, the data and the clock signal are transmitted and received along with signals having opposite phases to the data and the clock signal, respectively. Thus, the number of data and clock signal lines between the LCD transmitter and the LCD is half the number of lines between the LCD transmitter and the graphic chipset, i.e., about twenty. In case of a two-channel type, two pairs of clock signal lines are provided.

In using the LCD monitor as described above, the EMI greatly affects the image quality due to the characteristic of the LCD in comparison to the CRT monitor. Accordingly, filters for EMI reduction are installed on the data lines and the clock signal lines between the graphic chipset and the LCD transmitter and between the LCD transmitter and the LCD. As the EMI-reduction filter, an RC (resistance-capacitance) filter has a bead or resistor and a capacitor connected in parallel. Since the RC filters are selectively installed on the respective data lines and clock signal lines in accordance with the size of the EMI, RC filters at maximum can be installed.

In case that the RC filters are used on the respective data lines and clock signal lines, however, installation of the RC filters requires relatively a large space, and is complicated. Also, in case of the LVDS interface between the LCD transmitter and the LCD, the respective data lines and clock signal lines should be arranged at predetermined intervals to match the LVDS standard. This requires a large used area, and causes the circuit design in a limited space to become difficult.

Exemplars of the art are Korean Patent No. 1998-076463 issued to Oh, for LCD Module and System Using a Low Voltage Differential Signaling Device, Japanese Patent No. 11-24035 issued to Imashiro, for Liquid Crystal Display Device, Japanese Patent No. 11-313114 issued to Igarashi, for Signal Transfer Device, U.S. Pat. No. 5,631,920 issued to Hardin, for Spread Spectrum Clock Generator, U.S. Pat. No. 5,659,339 issued to Rindal et al., for Method and Apparatus for Reducing Electromagnetic Interference Radiated by Flat Panel Display Systems, U.S. Pat. No. 5,943,382 issued to Li et al., for Dual-Loop Spread-Spectrum Clock Generator with Master PLL and Slave Voltage-Modulation-Locked Loop, and U.S. Pat. No. 5,986,641 issued to Shimamoto, for Display Signal Interface System Between Display Controller and Display Apparatus.

SUMMARY OF THE INVENTION

It is therefore an object to provide a computer system and an image processing method that can reduce the EMI introduced into the LCD with a simple construction.

It is another object to provide a simple construction to reduce the electromagnetic interference introduced into the liquid crystal display.

It is yet another object to reduce the space for constructing the liquid crystal display interface and also reduce the electromagnetic interference affecting the liquid crystal display.

It is still yet another object to reduce elements in an image processing unit that can also reduce the electromagnetic interference affecting the liquid crystal display.

In accordance with the present invention, to accomplish the above and other objects there is provided a computer system having an LCD for displaying an image signal processed according to a command signal from a CPU, and a clock generator for generating a clock signal for transmitting the command signal, the computer system including a graphic processing unit for converting the image signal provided from at least one of the CPU and a memory into a signal that can be displayed on a screen, and a spread spectrum unit, provided between the graphic processing unit and the LCD, for modulating a frequency of the clock signal from the clock generator within a predetermined frequency range.

It is preferable that the computer system further includes an LCD transmitter for transmitting the image signal to the LCD, and the spread spectrum unit is arranged between the graphic processing unit and the LCD transmitter, and is installed on a clock signal line for transmitting the clock signal.

In the present invention, the spread spectrum unit can modulate the frequency of the clock signal by linearly increasing or decreasing the frequency of the clock signal. The spread spectrum unit may be integrally formed with either of the graphic processing unit and the LCD transmitter.

In another aspect of the present invention, there is provided an image processing method for a computer system having an LCD for displaying an image signal processed according to a command signal from a CPU, and a clock generator for generating a clock signal for transmitting the command signal, the method including the steps of converting the image signal provided from at least either of the CPU and a memory into a signal that can be displayed on a screen, and modulating a frequency of the clock signal of the digitized image signal within a predetermined frequency range.

It is preferable that the frequency modulating step linearly modulates the frequency of the clock signal within the predetermined frequency range.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 4:
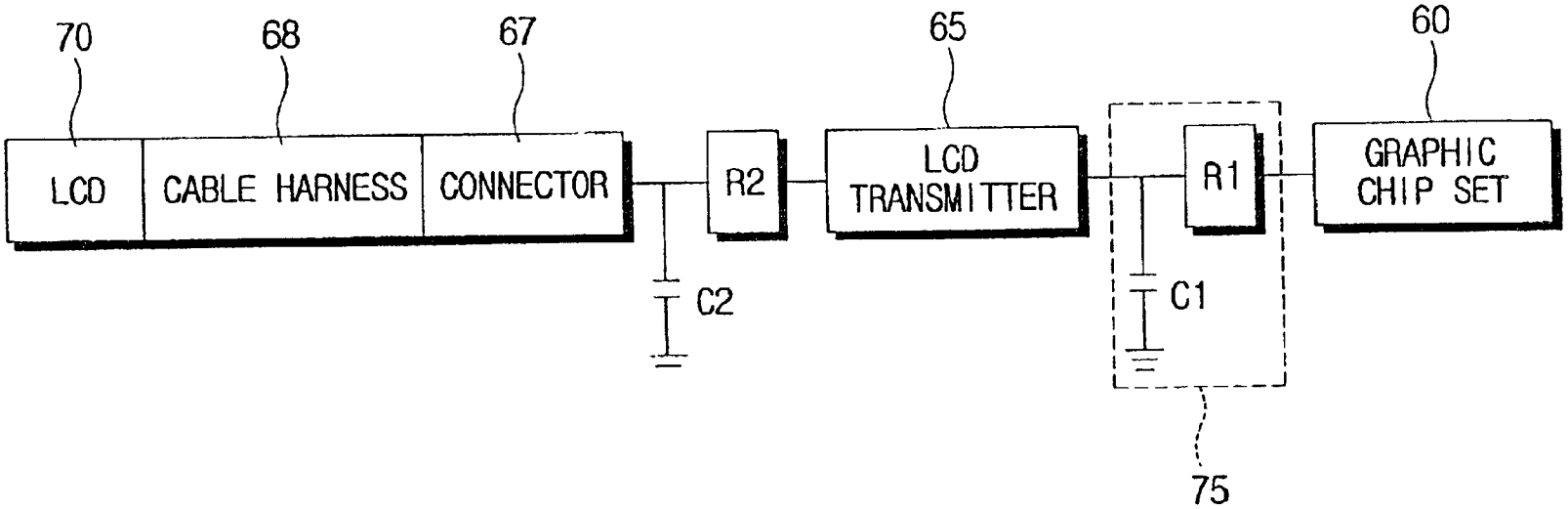
FIG. 4 is a block diagram illustrating the partial construction of an earlier computer system.

Turning now to the drawings, as shown in FIG. 4, the LCD monitor receives converted data and clock signal using a graphic chipset 60 and an LCD transmitter 65. The LCD 70 and the LCD transmitter 65 are connected together through a connector 67 and a cable harness 68. Here, the LCD transmitter 65 converts a data bus having RGB components into a low voltage differential signaling (LVDS) interface so that the image signal from the graphic chipset 60 is transmitted to the LCD 70 through copper lines at a high speed. The LCD transmitter 65 and the graphic chipset 60 are connected through about forty lines including thirty-six data lines and four clock signal lines to transmit the data and clock signal. Here, only one between the two pairs of clock signal lines is for transmitting the clock signal, and the three remaining clock signal lines relate to the transmission of the clock signal.

Meanwhile, since the LCD transmitter 65 and the LCD 70 transfer the data using the LVDS interface, the data and the clock signal are transmitted and received along with signals having opposite phases to the data and the clock signal lines, respectively. Thus, the number of data and clock signal lines between the LCD transmitter 65 and the LCD 70 is half the number of lines between the LCD transmitter 65 and the graphic chipset 60, i.e., about twenty. In case of a two-channel type, two pairs of clock signal lines are provided.

In using the LCD monitor 70 as described above, the EMI greatly affects the image quality due to the characteristic of the LCD 70 in comparison to the CRT monitor. Accordingly, filters for EMI reduction are installed on the data lines and the clock signal lines between the graphic chipset 60 and the LCD transmitter 65 and between the LCD transmitter 65 and the LCD 70. The EMI-reduction filter can be an RC filter 75 having a bead or resistor R1 and a capacitor C1 connected in parallel. Since the RC filters 75 are selectively installed on the respective data lines and clock signal lines in accordance with the size of the EMI, sixty RC filters 75 at maximum can be installed.

In case that the RC filters 75 are used on the respective data lines and clock signal lines, however, installation of the RC filters 75 requires relatively a large space, and is complicated. Also, in case of the LVDS interface between the LCD transmitter 65 and the LCD 70, the respective data lines and clock signal lines should be arranged at predetermined intervals to match the LVDS standard. This requires a large used area, and causes the circuit design in a limited space to become difficult.

Figure 1A:
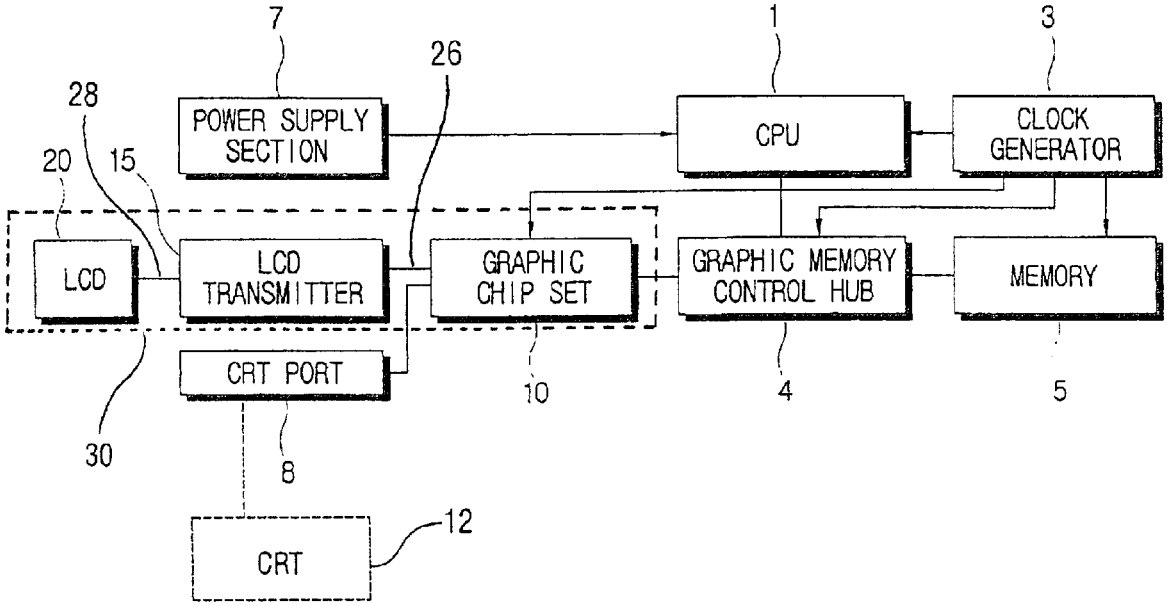
FIGS. 1*a* and 1*b* are a block diagrams illustrating the construction of the computer system according to the present invention.
Figure 1B:
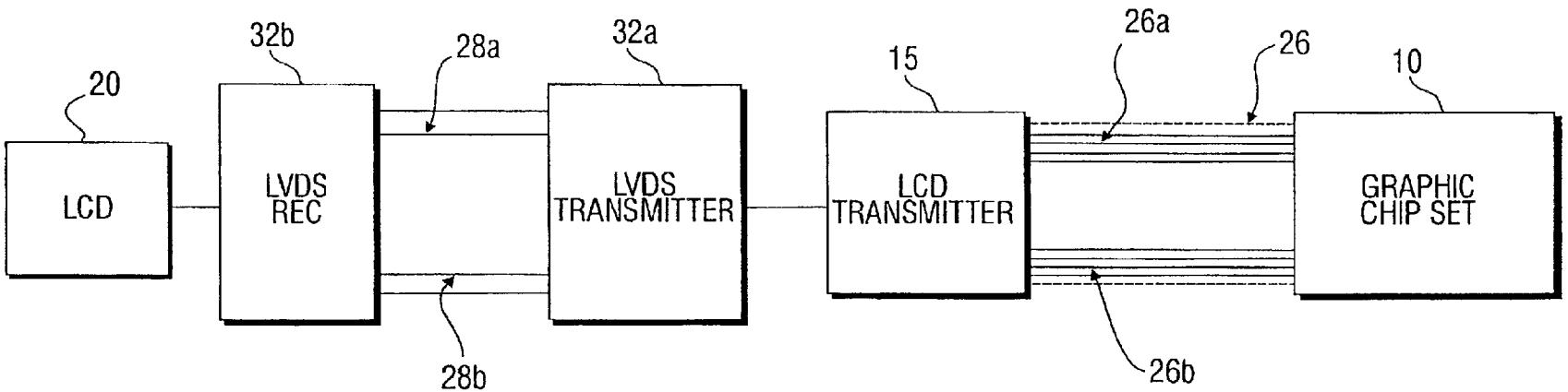

As shown in FIGS. 1*a* and 1*b* , the computer system according to the present invention includes a CPU 1 for processing a command signal from the outside, a power supply unit 7 for supplying a power to respective components, a clock generator 3 for generating a clock signal for transmitting the command signal to the respective components, a memory 5, and a graphic memory control hub 4 for interconnecting the components such as the CPU 1, memory 5, hard disk, etc., in accordance with the command signal. The computer system also includes an LCD 20, a graphic chipset 10 that is a graphic processing unit for converting the image signal from the memory 5 and the CPU 1 into a signal that can be outputted to the LCD 20, and an LCD transmitter 15 converting an interface so as to transmit the image signal from the graphic chipset 10 to the LCD 20 through copper lines at a high speed. Meanwhile, since a CRT port 8 is connected to the graphic chipset 10, it is also possible to support a CRT monitor 12.

Figure 2A:
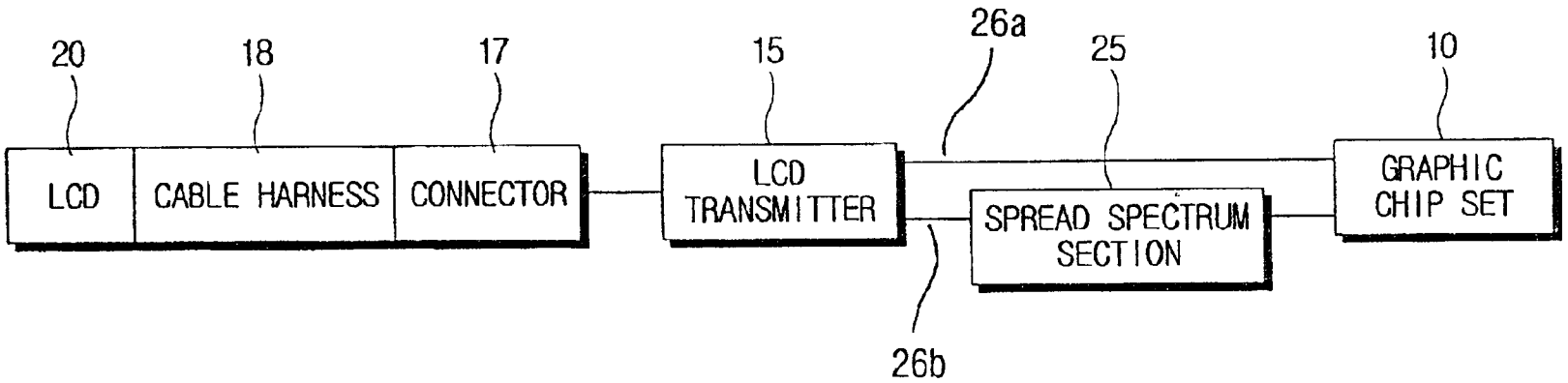
FIG. 2*a* is a block diagram illustrating the partial construction of an embodiment of the computer system according to the present invention.

Here, the LCD 20, graphic chipset 10, and LCD transmitter 15 constitute an LCD interface circuit 30. As shown in FIG. 2*a*, the LCD 20 and the LCD transmitter 15 are connected together through a connector 17 and a cable harness 18.

In the LCD interface circuit 30 as described above, a data bus having RGB (red, green, and blue) components and an LVDS interface 26 and 32 are used. Specifically, the data bus having the RGB components 26 is used between the graphic chipset 10 and the LCD transmitter 15, and the LVDS interface 32 is used between the LCD transmitter 15 and the LCD 20. The LCD transmitter 15 converts the data bus having the RGB components 26 into the LVDS interface 32. The LVDS interface 32 includes a LVDS transmitter 32*a* transmitting the signals from the LCD transmitter 15 to the LVDS receiver 32*b* through data lines 28*a* and clock signal lines 28*b*. The signals from the LVDS receiver 32*b* is forwarded to the LCD 20. Thus, in case of using two channels, about forty data lines 26*a* and clock signal lines 26*b* for transmitting the data are used between the graphic chipset 10 and the LCD transmitter 15 that use the data bus having the RGB components 26, and about twenty data lines 28*a* and clock signal lines 28*b* are used between the LCD transmitter 15 and the LCD 20 that use the LVDS interface 32. Here, a single clock signal line is arranged between the graphic chipset 10 and the LCD transmitter 15, and two pairs of clock signal lines are arranged between the LCD transmitter 15 and the LCD 20.

Meanwhile, in the LCD interface circuit 30 there is installed a spread spectrum unit 25 for removing the EMI introduced onto the clock signal lines 26*b* between the graphic chipset 10 and the LCD transmitter 15.

The spread spectrum unit 25 serves to modulate the frequency band (i.e., spectrum) of a specified signal using a method of widening the frequency band of the digital data of the specified frequency or moving the center frequency thereof. The frequency modulating method is classified into a center modulation type and a down modulation type. The center modulation type modulates the frequency within the same upper and lower frequency range centering around a reference frequency, and the frequency modulation is performed by linearly increasing or decreasing the frequency within the range of approximately ±0.05%~±0.025%, centering around the reference frequency. Accordingly, the mean frequency after the modulation is the same as that before the spread of the center frequency, and the transmission speed of the frequency does not become slow. As a result, in case of using the spread spectrum unit 25, the modulation is performed so that the energy of the reference frequency is spread, and thus the peak in the specified frequency can be prevented. Meanwhile, the down modulation type modulates the frequency by reducing the start frequency, so that the maximum frequency becomes identical to the reference frequency before the modulation. According to the down modulation type (method), the speed (frequency) of the CPU clock signal does not exceed the maximum frequency or the reference frequency before the modulation, but the whole clock speed and reference processing speed are reduced.

Figure 2B:
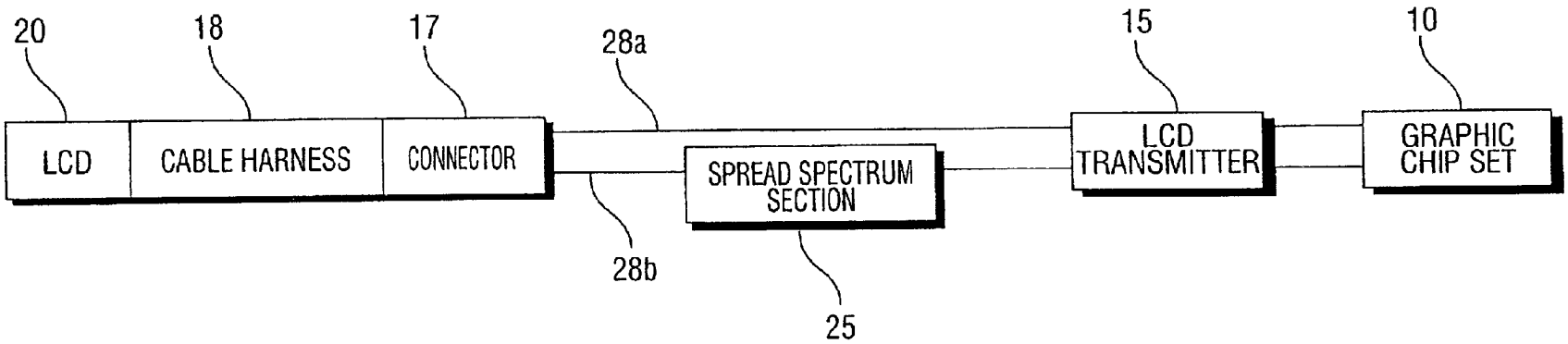
FIG. 2*b* is a block diagram illustrating the partial construction of another embodiment of the computer system according to the present invention.

The spread spectrum unit 25 as described above may be installed on every clock signal line 26*b* between the graphic chipset 10 and the LCD transmitter 15 in accordance with the size of the EMI. The spread spectrum unit 25 may be installed on the clock signal line 28*b* between the LCD 20 and the LCD transmitter 15, as seen in FIG. 2*b* but it is preferable that the spread spectrum unit 25 is installed on the clock signal line 26*b* between the graphic chipset 10 and the LCD transmitter 15 as seen in FIG. 2*a*.

Figure 3A:
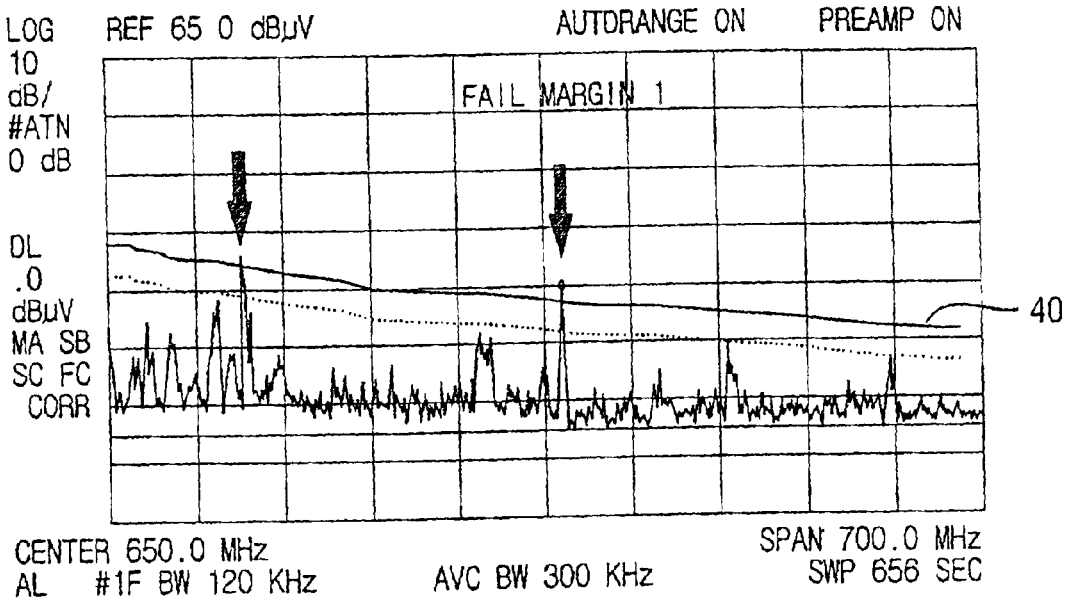
FIG. 3*a* is a graph illustrating an EMI produced on the CPU side that does not incorporate the spread spectrum unit.
Figure 3B:
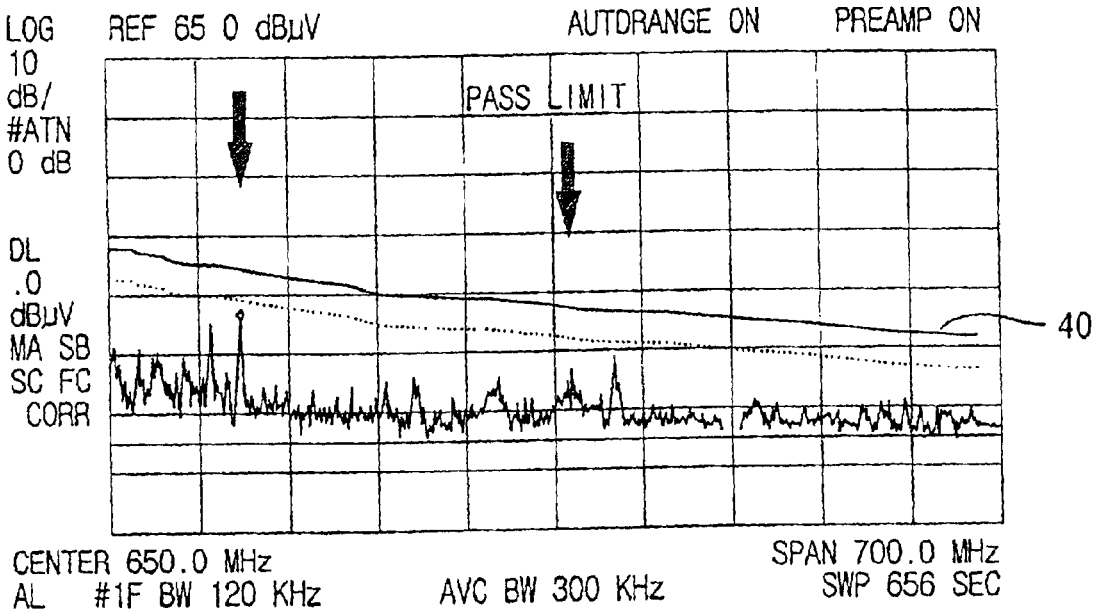
FIG. 3*b* is a graph illustrating an EMI produced on the CPU side that incorporates the spread spectrum unit.

Meanwhile, FIG. 3*a* is a graph illustrating an EMI produced on the CPU side that does not incorporate the spread spectrum unit. As shown in FIG. 3*a*, peaks are formed in the specified frequencies indicated as arrows, and this causes the EMI value to exceed the EMI limit line 40 indicated as a solid line. However, in the case that the spread spectrum unit is installed in the CPU, it linearly increases or decreases the frequency of the clock signal within the predetermined range, and thus, as shown in FIG. 3*b*, the frequency modulation is performed in the specified frequency indicated as an arrow, making the EMI value not exceed the EMI limit line 40.

Also, it can be expected that the same effect is obtained in the case that the spread spectrum unit 25 is installed in the LCD interface circuit.

As described above, according to the present invention, the EMI introduced into the LCD 20 is removed by installing only one spread spectrum unit 25 on the clock signal line 26*b* between the graphic chipset 10 and the LCD transmitter 15. Thus, the EMI introduced into the LCD 20 can be removed with a simple construction, and the space for constructing the LCD interface circuit can be reduced. Also, since only one spread spectrum unit 25 is used, the manufacturing cost is reduced with the manufacturing process and after-sales service becomes simplified.

Meanwhile, in the above described embodiment, the spread spectrum unit 25 is installed on the clock signal line between the graphic chipset 10 and the LCD transmitter 15, the spread spectrum unit 25 may be integrally formed into one chip with the graphic chipset 10 or the LCD transmitter 15.

As described above, the present invention can reduce the EMI introduced into the LCD with a simple construction.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A computer system, comprising:

a liquid crystal display for displaying an image signal processed according to a command signal from a central processing unit;

a clock generator for generating a clock signal for transmitting the command signal;

a graphic processing unit for converting the image signal provided from at least one of said central processing unit and a memory into a signal accommodating display on said liquid crystal display;

a liquid crystal display transmitter for transmitting the image signal to said liquid crystal display; and a spread spectrum unit, provided between said graphic processing unit and said liquid crystal display transmitter, for modulating a frequency of the clock signal from said clock generator within a predetermined frequency range, said spread spectrum unit, provided between said graphic processing unit and said liquid crystal display transmitter, having an input connected directly to said graphic processing unit and an output connected directly to said liquid crystal display transmitter, with an output of said liquid crystal display transmitter being connected to a connector unit and cable harness for connection to said liquid crystal display.

2. The computer system of claim 1, said spread spectrum unit being installed on a clock signal line for transmitting the clock signal.

3. The computer system of claim 2, said spread spectrum unit modulating the frequency of the clock signal by linearly increasing or decreasing the frequency of the clock signal.

4. The computer system of claim 1, said spread spectrum unit coupled with said liquid crystal display transmitter.

5. The computer system of claim 4, said spread spectrum unit being installed on a clock signal line for transmitting the clock signal.

6. The computer system of claim 1, further comprised of said spread spectrum unit modulating the frequency band of a specified signal by widening the frequency band of the digital data of a predetermined frequency.

7. The computer system of claim 1, further comprised of said spread spectrum unit modulating the frequency band of a specified signal by moving the center frequency.

8. The computer system of claim 1, with said spread spectrum unit being installed on the clock signal lines between said graphic processing unit and liquid crystal display transmitter in accordance with the size of electromagnetic interference.

9. The computer system of claim 1, with said spread spectrum unit being installed on only a single clock signal line between said graphic processing unit and liquid crystal display transmitter.

10. An apparatus, comprising:

a display unit providing a variable video image;

a graphic processing unit converting an input signal into an image signal for display on said display unit;

a display transmitter for transmitting the image signal to said display; and a spread spectrum unit, provided between said graphic processing unit and said display transmitter, and for modulating frequency of a clock signal, said spread spectrum unit, provided between said graphic processing unit and said display transmitter, having an input connected directly to said graphic processing unit and an output connected directly to said display transmitter, with an output of said display transmitter being connected to a connector unit and cable harness for connection to said display unit.

11. The apparatus of claim 10, said spread spectrum unit being installed on a clock signal line for transmitting the clock signal.

12. The apparatus of claim 11, said spread spectrum unit modulating the frequency of the clock signal by linearly increasing or decreasing the frequency of the clock signal.

13. The apparatus of claim 10, said spread spectrum unit being integrally formed with said graphic processing unit.

14. The computer system of claim 10, said spread spectrum unit being integrally formed with said display transmitter.

15. The apparatus of claim 10, said spread spectrum unit being coupled with said display transmitter.

16. The apparatus of claim 15, said spread spectrum unit being installed on a clock signal line for transmitting the clock signal.

* * * * *